United States Patent [19]

Mori

[11] Patent Number: 4,851,823

[45] Date of Patent: Jul. 25, 1989

[54] FIRE ALARM SYSTEM

[76] Inventor: Kei Mori, 3-16-3-501, Kaminoge, Setagaya-ku, Tokyo, Japan

[21] Appl. No.: 147,395

[22] Filed: Jan. 25, 1988

[30] Foreign Application Priority Data

Mar. 20, 1987 [JP] Japan ..... 62-67291

[51] Int. Cl.[4] ..... G08B 3/00; G08B 25/02

[52] U.S. Cl. ..... 340/691; 340/692

[58] Field of Search ..... 340/691–692, 340/584, 628, 505, 825.54, 825.55

[56] References Cited

U.S. PATENT DOCUMENTS 3,906,491 9/1975 Gosswiller et al. ..... 340/692 X
4,107,464 8/1978 Lynch et al. ..... 340/692 X
4,375,637 3/1983 Desjardins ..... 340/825.55 X
4,560,978 12/1985 Lemelson ..... 340/692 X
4,682,348 7/1987 Dawson et al. ..... 340/692 X
4,703,312 10/1987 Berry, III ..... 340/692 X
4,709,330 11/1987 Yokoi et al. ..... 340/573 X

*Primary Examiner*—Glen R. Swann, III
*Assistant Examiner*—Thomas J. Mullen, Jr.
*Attorney, Agent, or Firm*—Jordan and Hamburg

[57] ABSTRACT

A fire alarm system is installed in a building containing therein a large number of rooms such as inns, hotels, office buildings and the like. The system comprises fire detectors, microphones and speakers installed in different rooms and connected to an administration room, so that when one of the fire detectors is put into operation, the microphone and the speaker turn on and inform the administration room of the operation of the fire detector. A conversation can be exchanged between the administration room and the room in which the fire detector is put into operation.

19 Claims, 3 Drawing Sheets

FIRE ALARM SYSTEM

BACKGROUND OF THE INVENTION

The present invention relates to an effective fire alarm system installed in a building containing therein a large number of rooms such as inns, hotels, office buildings and the like.

In general practice, as a fire counter-measure in hotels, buildings, etc., a fire detector is installed in different rooms. When the fire detector is activated an alarm, such as a buzzer, is sounded or a warning lamp in the administration room lights up. Otherwise, the signal is relayed to a fire station.

However, since a fire detector is put into operation even when there is no fire, there are many actual cases in which an alarm system is kept in a non-operating state. In such cases large-scale disasters are likely to occur. Furthermore, when a fire does actually break out, persons sleeping in a burning room don;t notice it or otherwise they become busy trying to extinguish the fire and sometimes fail to escape.

SUMMARY OF THE INVENTION

It is an object of the present invention to provide a fire alarm system capable of a communication between the guest room and the administration room at the initial stages of a fire or immediately after a fire detector has begun to operate.

It is another object of the present invention to provide a fire alarm system capable of giving suitable instructions for fire-extinguishing or sheltering to persons staying at the actual site of the fire, after completely grasping the situation, and further to minimize the extent of the disaster.

It is another object of the present invention to provide a fire alarm system capable of confirming whether a fire is occurred or not in a room by making inquiries to persons staying in the room where a fire detector is operated.

It is another object of the present invention to provide a fire alarm system, in the case of no fire, the execution of the proper steps suitable for the occasion shall be pointed out.

It is another object of the present invention to provide a fire alarm system, in the case of an actual, the execution of effective fire-extinguishing and sheltering procedures shall be out for the person staying at the actual site of the fire.

DESCRIPTION OF THE PREFERRED EMBODIMENTS

Figure 1:
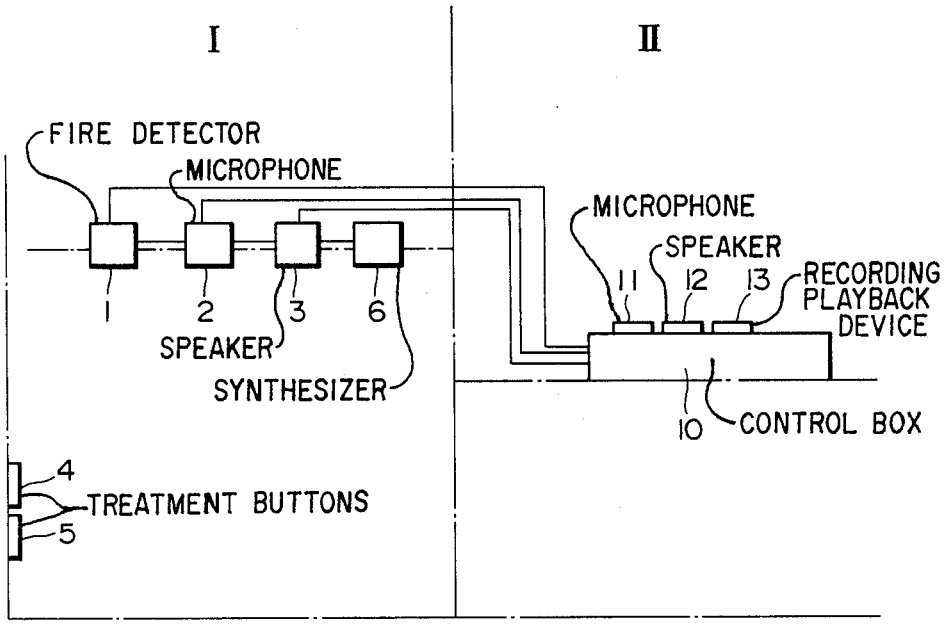
FIG. 1 is an explanatory construction diagram for explaining an embodiment of the present invention.

FIG. 1 is an explanatory block diagram for explaining an embodiment of the present invention. An example of a fire alarm system for use in hotels is described hereinafter. In FIG. 1, I and II represent respectively a guest room side and an administration room side. Although only one room is shown on the guest room side, all of the guest rooms are constructed in the same way.

In FIG. 1, 1 is a fire detector, 2 a microphone, 3 a speaker, 4 a treatment button used in the case of the occurrence of a fire, and 5 a treatment button used in the case of no fire. Those elements are installed at an optional place in the respective rooms. Generally, the elements 1 to 3 are installed on the ceilings of the rooms, and the elements 4 and 5 on the walls of the rooms. Usually or often, the microphone 2 and the speaker 3, etc. are turned off, and the treatment button 4 for use in case of a fire and the treatment button 5 for use in the case of no fire, are locked to keep them in an inoperative state. Otherwise, the power source for the electric circuit, caused by the buttons 4 and 5, is switched off. In any case, all of those elements are put into an inoperative state by manipulating those buttons.

In FIG. 1, 10 is a control box, 11 a microphone, 12 a speaker, and 13 a recording-play back device. Those elements are installed in the administration room. Here, assuming that the fire detector 1 is activated in a guest room because of a fire or others, the microphone 2 and the speaker 3 are turned on through the operation of the fire detector 1. At the same time, the lamp which is installed, for instance, on the control box 10 of the administration room, and which corresponds to the above-mentioned guest room is lit up and a buzzer is sounded. And further, the microphone 11, the speaker 12 and the recording-play back device 13 installed in the administration room are switched to the "ON" position and kept in the state in which a conversation can be automatically exchanged between one of the guest rooms and the administration room. Furthermore, the recording-play back device starts recording the conversation.

Consequently, when the supervisor of the administration room asks a question over the microphone 11, as for example, saying "Has a fire broken out?", a voice duplicating the same message comes out from the speaker 3 in the guest room. To hear the sound of the voice, a person staying therein answers by saying "Yes, a fire has broken out." in the case of the occurrence of a fire or by saying "No, there is no fire." in the case of no fire.

When a fire breaks out in actuality, the supervisor of the administration room gives instructions on how to extinguish the fire, for example by pushing the fire treatment button 4, or by instructing the person staying in the guest room how to take shelter from the fire as for example informing him where the nearest fire escapes are located. At the same time the supervisor notifies the appropriate authorities such as the fire department. On the contrary, in the case of no fire, the supervisor makes an inquiry as to why the fire detector was activated and gives suitable instructions, as for example, instructions on pushing the no-fire treatment button 5 or on opening the windows in the guest room.

In such a situation, when button 4 is pushed, for example, the sprinkler in the guest room operates to extinguish the fire and the fire station is notified automatically. On the other hand, when button 5 is pushed, the reason why the fire detector operated is removed, for example, in the case when the fire detector is of the smoke-detecting type, the air conditioner is automatically started to remove smoke from the guest room. Furthermore, in the case when the fire detector is of the heat-sensitive type, the air conditioner is also put into operation so as to lower the temperature of the guest room. And further, the same operation as that used by pushing buttons 4 and 5 can be performed in the administration room. Therefore, it's possible for the supervisor to do the same as mentioned above in the case of a fire or no fire.

As embodiment of the present invention in which a conversation can be exchanged between a person staying at a place where the fire detector is put into operation and the supervisor of the adminstration room, immediately after the fire detector becomes activated has been described, heretofore. However, there were many cases in which no supervisor stayed in the administration room, or the supervisor stayed at a place quite distant from the administration room and thus it took a long time for him to get back to the microphone. On such occasions, a countermeasure could not be taken so quickly in the early stages of the occurrence of a fire requiring a quick response.

In consideration of such circumstances, it may be desirable to give the message "Has a fire broken out?" to the person in the room where the fire detector is activated. In FIG. 1, 6 is a synthesizer installed in the guest room for the above-mentioned purpose. On such occasions, when the fire detector 1 operates, the microphone 2 and the speaker 3, etc. are turned on, and the synthesizer 6 operates at the same time. The voice previously recorded in the synthesizer 6 comes out from the speaker 3. For instance, the speaker 3 makes an inquiry about the fire, saying "Has a fire broken out?".

In such a way, it might be possible to make a first inquiry about the fire to the person in the guest room at the time of the fire's occurrence without involving the supervisor. Therefore, the initial fire-extinquishing activity and the advice about seeking shelter from the fire can be done promptly. Furthermore, the voice from the speaker 3 is transferred the microphone 2, and thereby the above-mentioned voice "Has a fire broken out?" is relayed to the supervisor staying in the administration room through speaker 12. Consequently, such information transmitted therethrough gives the supervisor a feeling of tension and an earlier warning so that he can respond more promptly.

Furthermore, as in the case of the afore-mentioned embodiment, the push buttons 4 and 5 are put into an operable condition or the electric circuit caused by those push buttons is activated in connection with the fire detector 1, and the recording-play back device 13 is put into operation to record the voice of the conversation exchanged therebetween.

And further, in the above-mentioned case, it doesn't necessarily follow that the supervisor has to stay in the administration room. If the supervisor isn't there, it is not possible to reach him. Assuming such a situation, in the case of equipping the building with a fire alarm system, according to the present invention, various suitable instructions are given to relevant persons. Namely, the system points out the relevant persons who can put the synthesizer 6 into an operable condition, and who can push button 4 in the case of a fire or push button 5 in the case of no fire.

Figure 2:
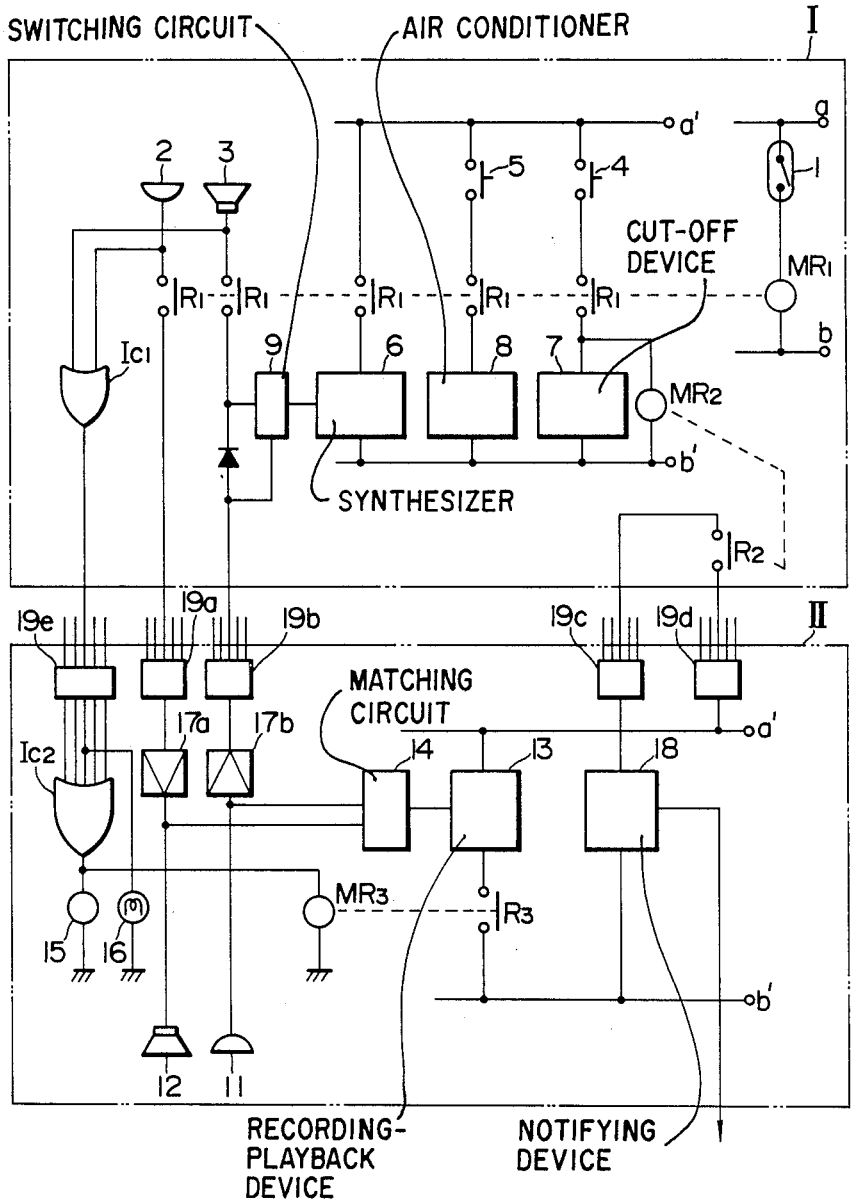
FIG. 2 is a circuit diagram for explaining in detail the embodiment shown in FIG. 1.

FIG. 2 is a circuit diagram for explaining in detail the operation of the fire alarm system according to the present invention shown in the afore-mentioned drawing (FIG. 1). In FIG. 2, 7 is a cutter for cutting off the heat-sensitive element in the case when the sprinkler is activated by cutting off the heat-sensitive element, 8 an air-conditioning device, 9 a switching circuit, 14 a matching circuit, 15 a buzzer, 16 a monitor lamp, 17*a* and 17*b* amplifiers respectively, 18 an external notifying device, 19*a* through 19*e* distribution terminals, $IC_1$ and $IC_2$ circuit elements, $MR_1$ through $MR_5$ magnet relay coils, and $R_1$ through $R_5$ contact points of the respective magnet relay coils $MR_1$ through $MR_5$. Concerning the other parts, a reference numeral same as that of FIG. 1 is attached to the part performing the same action as that of FIG. 1.

In FIG. 2, assuming that the fire detector 1 installed in the guest room I is activated by reason of the fire or others, the relay coil $MR_1$ is excited by the action of turning on the aforementioned fire detector 1, and thereby all of the contact points $R_1$ of this relay coil $MR_1$ are put in the state "ON". As a result, the synthesizer 6 is activated, and the microphone 2 and the speaker 3 are respectively connected with the amplifiers 17*a* and 17*b* which are normally powered on.

On such occasion, the electric signal obtained by connecting the microphone 2 and the speaker 3 therewith is fed back through the circuit elements $IC_1$ and $IC_2$ to the administration room side II. At this time, the buzzer 15 emits a sound and the monitor lamp 16 is lit up. In such a way, the occurrence of anything unusual in the guest room I is notified to the supervisor. When the buzzer 15 is activated, the relay coil $MR_3$ connected in parallel with the buzzer 15 is excited at the same time and its contact point $R_3$ is switched on. And then, the recording-replaying device 13 is activated and the respective sounds of the microphone 2 and 11 and the sound of the synthesizer 6 are automatically recorded therein through the matching circuit 14.

By performing a series of operations as mentioned heretofore, a conversation can be exchanged between the guest room side I and the administration room side II. At this time, after making a confirmation of fire occurrence, the supervisor points out the person staying in the guest room to push the fire treatment push button 4 in the case of fire or to push the no fire treatment push button 5 in the case of no fire.

Moreover, in the fire alarm system according to the present invention, the afore-mentioned synthesizer 6 is installed therein and it is always activated with priority to the others regardless of presence of absence of the supervisor in the administration room. And further, the informations such as "Has a fire broken out?", "Push the push button 4 in the case of fire.", "Push the push button 5 in the case of non-fire.", or the like are previously recorded in the synthesizer 6. Therefore, even though the supervisor doesn't stay in the administration room, an adequate indication can be delivered to the persons staying in the guest room I.

At this time, the voice sound signal output transmitted from the afore-mentioned synthesizer 6 is emitted from the speaker 3 through the switching circuit 9. At first, in the case of the occurrence of a fire, when the fire treatment button 4 is pushed, since the contact point $R_1$ of the relay coil $MR_1$ is kept to be put in a state of "ON" the cutter 7 is activated in order to cut off the heat-sensitive element for putting the sprinkler into operation and, at the same time, the relay coil $MR_2$ connected in parallel with the cutter 7 of the heat-sensitive element for putting the sprinkler into operation is excited. At this time, the contact point $R_2$ thereof is switched on and thereby the external notifying device 18 installed in the administration room II is activated in order to automatically notify the fire station of the occurrence of a fire.

Secondly, in the case of no fire, as for example, when the fire detector is activated by the smoke of cigarette or the increase of room temperature, since the contact point $R_1$ of the relay coil $MR_1$ is kept to be put in a state of "ON", pushing operation of the no fire treatment button 5 causes the air conditioning device 8 to operate. The air-conditioning in the room can be performed in such way.

Furthermore, since the contact point $R_1$ of the relay coil $MR_1$ is put in a state of "OFF", the fire treatment button 4 and the no fire treatment button 5 are interlocked so as not to be capable of operating at the time except for the occurrence of an unusual thing. And further, as mentioned above, regardless of presence or absence of the supervisor in the administration room the voice sound signal output of the synthesizer 6 is emitted from the speaker 3. When the supervisor stays in the administration room exchange a conversation with the person staying in the guest room, the voice sound of the supervisor is emitted from the speaker 3 in a similar way. In order to avoid the confusion due to both of those sound voices, when the supervisor gives an instruction to persons in the guest room through the microphone 11, for instance, by detecting the voice sound signal "Has a fire broken out?" the switching circuit contained in the fire alarm-system automatically cuts off the output of the afore-mentioned synthesizer 6 from the speaker 3.

Figure 3:
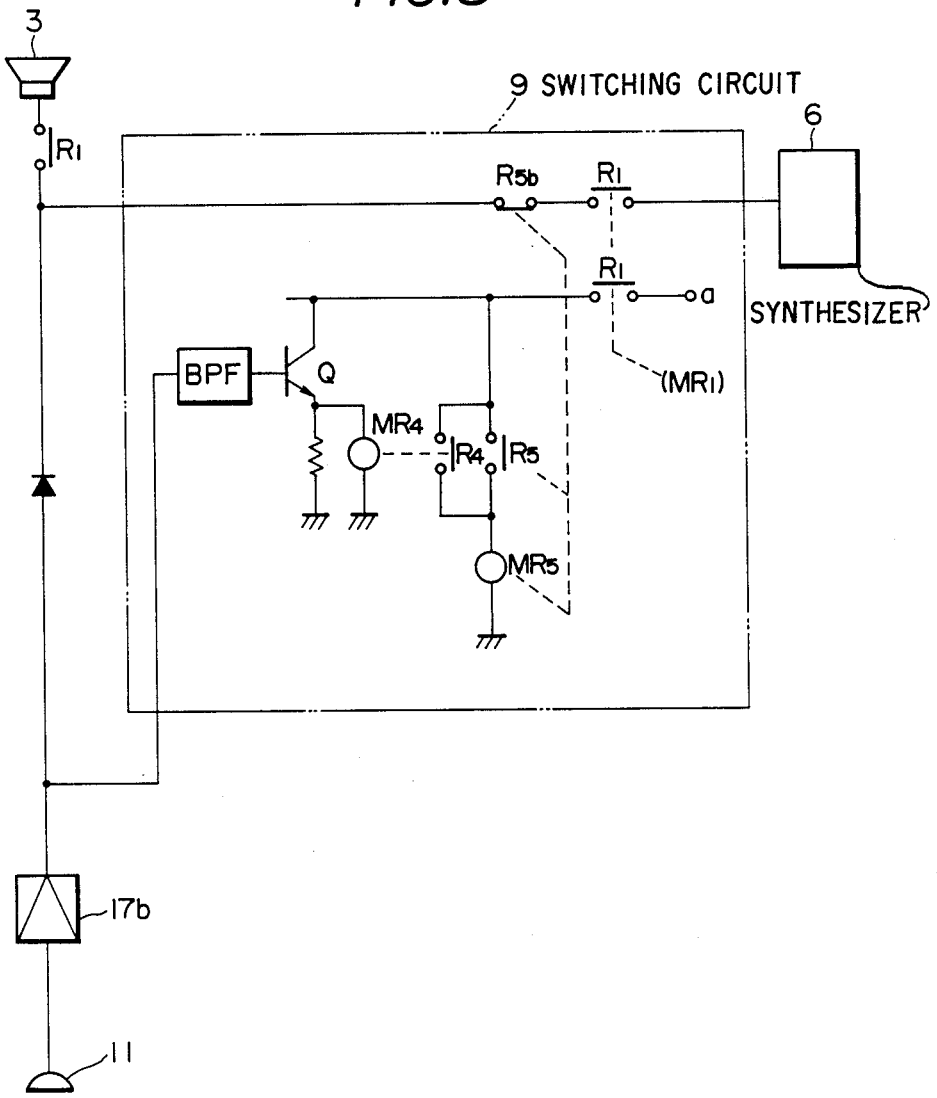
FIG. 3 is a circuit diagram showing in detail the switching circuit shown in FIG. 2.

FIG. 3 is a circuit diagram for explaining the operation of the above-mentioned switching circuit. When the fire detector 1 starts to operate the voice sound signal of the synthesizer 6 is emitted from the speaker 3 through the switching circuit 9. The person in the guest room is notified of anything unusual by the speaker 3. At the same time, the supervisor in the administration room is also notified of the unusual thing by the buzzer 1 and the monitor lamp 16.

The supervisor noticing the unusual thing gives a voice sound signal "Has a fire broken out?" to the microphone 11, and the given voice sound signal is discharged from the speaker 3 through the amplifier **17*b*** so as to put a question to the person staying in the guest room of the actual situation therein.

At this time, since the voice sound signal "Has a fire broken out?" branched off from the amplifier **17*b* is input into the base of the transistor Q through the bandpass filter BPF, the transistor Q is turned on, and the relay coil $MR_4$ is excited and its contact point $R_4$ is also switched on. When the contact point $R_4$ is switched on, the relay coil $MR_5$ is excited and, at the same time, its contact point $R_5$ is also switched on. In consequence, the relay coil $MR_5$ is put into a self-holding condition. Afterwards, regardless of presence of absence of the voice sound signal from the microphone 11, the relay coil $MR_5$ is kept to be in a condition of being exicted. Namely, it follows that, since the relay coil $MR_5$ is in a state of being excited, the contact point $R_{5b}$ connected between the synthesizer 6 and the speaker 5 is put in a state of "OFF", and thereby the synthesizer 6 and the speaker 3** are kept in a state of being separated from each other.

As is explained heretofore, in the case when the supervisor stays in the administration room II, the supervisor automatically turns off the output of the synthesizer 6 by means of the voice sound signal discharged from the microphone 11, so that the voice sound of the supervisor and that of the synthesizer are prevented from confusing with each other.

Furthermore, in FIG. 2, although only one room is shown at the guest room side I, the terminals of the other rooms are connected with the distribution terminals **19*a* through 19*e* respectively. In such a way of connection, all of the guest rooms can be constructed equally. And further, in the circuit diagrams shown in FIG. 2 and FIG. 3**, the relay coils $MR_1$ through $MR_5$ are employed for convenience of operational explanation. However, in practice, those portions can be easily constructed with the electronic circuit.

As is apparent from the foregoing description, according to the present invention, a conversation can be exchanged between the guest room and the administration room at the initial stages of a fire and immediately after a fire has broken out and the fire detector has begun to operate. Therefore, it may be possible to give suitable instructions for fire-extinguishing or sheltering to persons staying at the actual site of the fire, after completely grasping the situation, and further to minimize the extent of the disaster. Furthermore, even in the case when the fire detector is activated in the case of no fire, adequate response can be made without falling into a state of panic. For the above reasons, the alarm circuit doesn't need to be kept in an inoperative condition, and as a result there is no possibility of a large-scale disaster occurring.

I claim:

1. A fire alarm system for use in a building having a plurality of rooms and having response devices for responding to fire-related conditions comprising room fire detector means and room voice communication means located in a plurality of rooms in said building, an administrative control means installed in an administrative area of said building, said control means comprising indicating means connected to each of said fire detector means to provide an indication in said administrative area when any of said fire detector means has been activated by a fire-related condition in said room, said control means further comprising an administrative voice communication means connected to each of said room voice communication means to provide for voice communication between said administrative area and each of said rooms, and manual activation means installed in each of said rooms for activating a response device in the respective room for providing a response to a fire-related condition which caused activation of said fire detector means, said manual activation means and said voice communication means being placed in an operable state when said fire detector means has been activated by said fire-related condition.

2. A fire alarm system according to claim 1, wherein said manual activation means comprises a first manually operated device operable to initiate one response device which is responsive to one fire-related condition in said room and a second manually operated device operable to initiate another response device which is responsive to another fire-related condition in said room.

3. A fire alarm system according to claim 2, wherein said one response device is a sprinkler system and said other response device is an air conditioner.

4. A fire alarm system according to claim 2, wherein said manual activation means has an operable and a non-operable state, said manual activation means having electrical connecting means connected to said fire detector means such that said manual activation means is activated from its non-operable to its operable state when said fire detector means is activated upon detecting a fire-related condition is said room.

5. A fire alarm system according to claim 1, wherein said response device is a sprinkler system, said control means comprising notification means in said administrative area connected to said manual activation means to provide a notification in said administrative area that said manual activation means has been manually activated.

6. A fire alarm system according to claim 1, wherein said response device is a sprinkler system having a heat-sensitive element and cut-off circuit means in each of said rooms which cuts off said hest-sensitive element when said manual activation means has been manually activated to thereby set off said sprinkler system, said control means further comprising notification means in said administrative area and connected to said cut-off circuit means for providing a notification in said administrative area that said manual activation means has been activated.

7. A fire alarm system according to claim 1, wherein each of said room voice communication means and said administrative voice communication means define a plurality of interconnected voice communication means between each of said rooms and said administrative area, each of said interconnected voice communication means having an operable and a non-operable state, said control means comprising electrical connecting means between each of said interconnected voice communication means and the respective fire detector means in each of said rooms such that each of said interconnected voice communication means is activated from its non-operable to its operable state when the respective fire detector means is activated upon detecting a fire-related condition in the respective room.

8. A fire alarm system according to claim 1, wherein each of said voice communication means comprises a microphone and a speaker, further comprising a recording-play back means in said administrative area for recording voice communication over said microphone and speaker in said administrative area, said recording play back means being activated to an operable state when said fire detector means has been activated.

9. A fire alarm system according to claim 8 further comprising a synthesizer in each of said rooms for delivering a prerecorded voice message to the occupant of said room, and means connecting said synthesizer in each room to the respective fire detector means in each room to initiate operation of said synthesizer when the respective fire detector means has been activated upon detecting a fire-related condition in said room.

10. A fire alarm system according to claim 9 further comprising switching circuit means in each of said rooms for switching off said synthesizer in each of said rooms when said speaker in said administrative area is voice-activated.

11. A fire alarm system for use in a building having a plurality of rooms and having response devices for responding to fire-related conditions comprising room fire detector means, a microphone, a speaker and a synthesizer located in a plurality of rooms, said synthesizer being operable to deliver a prerecorded voice message to the occupant of said room, an administrative control means installed in an administrative area of said building, said control means comprising a mirophone and a speaker connected to each of the respective speakers and microphones in each of said rooms to provide voice communication between said administrative area and each of said rooms, and manual activation means installed in each of said rooms for activating a response device which provides a response to a fire-related condition which caused activation of said fire detector means, said microphone and said speaker along with said manual operation means and said synthesizer in each room being placed in an operable state when the respective fire detector means in each room has been activated, whereby said synthesizer delivers a voice message to the occupant in said room and said message is adapted to be acted upon by said room occupant to manually initiate operation of said manual activation means in response to said voice message, said voice message also being communicated to said administrative area by said microphone in said room and said speaker in said administrative area.

12. A fire alarm system according to claim 11, wherein said manual activation means comprises a first manually operated device operable to initiate one response device which is responsive to one fire-related condition in said room and a second manually operated device operated to initiate another response device which is responsive to another fire-related condition in said room.

13. A fire alarm system according to claim 12, wherein said one response device is a sprinkler system and said other response device is an air conditioner.

14. A fire alarm system according to claim 11, wherein said response device is a sprinkler system, said control means comprising notification means in said administrative area connected to said manual activation means to provide a notification in said administrative area that said manual activation means has been manually activated.

15. A fire alarm system according to claim 11, wherein said response device is a sprinkler system having a heat-sensitive element, a cut-off circuit means in each of said rooms which cuts off said heat-sensitive element when said manual activation means has been manually activated to thereby set off said sprinkler system, said control means further comprising notification means in said administrative area and connected to said cut-off circuit means for providing a notification in said administrative area that said manual activation means has been activated.

16. A fire alarm system according to claim 11, wherein said manual activation means has an operable and a non-operable state, said manual activation means having electrical connecting means connected to said fire detector means such that said manual activation means is activated from its non-operable to its operable state when said fire detector means is activated upon detecting a fire-related condition in said room.

17. A fire alarm system according to claim 11 further comprising a recording-play back means in said administrative area for recording voice communication over said microphone and speaker in said administrative area, said recording-play back means being activated to an operable state when said first detector means has been activated.

18. A fire alarm system according to claim 11 further comprising switching circuit means in each of said rooms for switching off said synthesizer in each of said rooms when said speaker in said administrative area is voice-activated.

19. A fire alarm system according to claim 11, wherein said control means further comprises indicating means providing an indication in said administrative area when said fire detector means has been activated by a fire-related condition in the respective room.

* * * * *